US007204324B2

(12) United States Patent
Gleitman et al.

(10) Patent No.: US 7,204,324 B2
(45) Date of Patent: Apr. 17, 2007

(54) ROTATING SYSTEMS ASSOCIATED WITH DRILL PIPE

(75) Inventors: Daniel D. Gleitman, Houston, TX (US); Paul F. Rodney, Spring, TX (US); James H. Dudley, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 84 days.

(21) Appl. No.: 11/071,823

(22) Filed: Mar. 3, 2005

(65) Prior Publication Data

US 2005/0194187 A1 Sep. 8, 2005

Related U.S. Application Data

(60) Provisional application No. 60/549,852, filed on Mar. 3, 2004.

(51) Int. Cl.
*E21B 4/04* (2006.01)

(52) U.S. Cl. ..... 175/57; 175/104

(58) Field of Classification Search ..... 175/57, 175/104, 106; 166/66.4
See application file for complete search history.

(56) References Cited

U.S. PATENT DOCUMENTS

| | | | | | |
|---|---|---|---|---|---|
| 1,391,626 | A * | 9/1921 | Gilthorpe | 175/98 |
| 4,690,212 | A * | 9/1987 | Termohlen | 166/65.1 |
| 4,721,172 | A * | 1/1988 | Brett et al. | 175/26 |
| 4,722,402 | A * | 2/1988 | Weldon | 175/104 |
| 5,725,061 | A * | 3/1998 | Van Steenwyk et al. | 175/104 |
| 6,234,259 | B1 * | 5/2001 | Kuckes et al. | 175/73 |
| 6,241,029 | B1 * | 6/2001 | Coenen et al. | 175/44 |
| 2004/0262043 | A1 * | 12/2004 | Schuaf | 175/57 |
| 2005/0173570 | A1 * | 8/2005 | Tanaka et al. | 241/36 |

OTHER PUBLICATIONS

International Search Report and Written Opinion of the International Searching Authority for PCT/US05/07062 filed Oct. 3, 2006.

* cited by examiner

*Primary Examiner*—William P Neuder
(74) *Attorney, Agent, or Firm*—Baker Botts L.L.P.

(57) ABSTRACT

Methods and apparatuses for drilling a borehole are disclosed. An electric motor electrically and mechanically coupled to a wired drill pipe is provided. The electric motor couples to a shaft that rotates when power is supplied to the electric motor. The shaft is couplable to a drill bit. The wired drill pipe transfers electricity to the electric motor from the surface. Operation of the electric motor rotates the shaft. The drill bit wears away earth to form the borehole in the earth.

26 Claims, 6 Drawing Sheets

ROTATING SYSTEMS ASSOCIATED WITH DRILL PIPE

CROSS-REFERENCE TO RELATED APPLICATION

This application claims priority to commonly owned U.S. provisional patent application Ser. No. 60/549,852, filed Mar. 3, 2004, entitled "Rotating Systems Associated with Drill Pipe," by Daniel D. Gleitman, Paul F. Rodney, and James H. Dudley.

BACKGROUND

In traditional systems for drilling boreholes, rock destruction is carried out via rotary power conveyed by rotating the drill string at the surface using a rotary table or by rotary power derived from mud flow downhole using, for example, a mud motor. Through these modes of power provision, traditional bits such as tri-cone, polycrystalline diamond compact ("PDC"), and diamond bits are operated at speeds and torques supplied at the surface rotary table or by the downhole motor.

In some circumstances and under some drilling conditions when using these traditional techniques, the drilling rate (or rate of penetration, "ROP") may be compromised. When that occurs, the operator has several options to improve the drilling rate. The operator can trip out the drill string for a new drilling assembly more likely to be successful in drilling under the existing circumstances. Alternatively, if a rotary table on the surface provides the drilling power, the operator can change the rotary speed within a relatively narrow range, such as approximately 60 to 250 revolutions per minute ("RPM"). If the drilling system includes a downhole positive-displacement motor ("PDM"), the operator can change the motor speed over a range, for example, of approximately 150 RPM to approximately 300 RPM (for a medium speed 6¾-inch motor). A change in motor speed, however, can produce proportionate flow rate changes that can have a profound effect on hole cleaning, pressure drop, and other factors. As yet another alternative, the operator can attempt to adjust the weight on bit by adjusting the hook load at surface.

In all of these techniques the operator is remote, both in distance and time, from the changing bottom hole conditions that caused the compromised ROP. As a consequence, it may take some time for the compromised ROP to manifest itself at the surface and for the operator to recognize that the ROP has decreased. In addition, the operator's response actions, such as adjusting the rotary speed, hook load, or flow rate, are equally remote from the bit on bottom. Various load factors such as torque and drag may attenuate the operator's control action and compromise its effectiveness.

Continuous movement, including rotation, of the drill string has important benefits in addition to transferring power to the bit. Torque and drag consumption along the drill string due to frictional losses may reduce the weight and rotary torque available to be transferred to the bit, which may cause the power available at the bit to be variable or unpredictable. This power variability may, in turn, compromise ROP. An important source of frictional loss is static friction, which typically occurs during non-rotary periods, momentary stoppages of the pipe during sliding due to stick/slip, and periodic stoppages during additions of drill pipe. In addition to the static friction, an immobile pipe string is more likely to become differentially stuck due to pressure differential between the hole and the formation.

Further, pipe rotation is known to keep the cuttings mobile and off the bottom of the hole, especially in horizontal wells.

DETAILED DESCRIPTION

Figure 1:
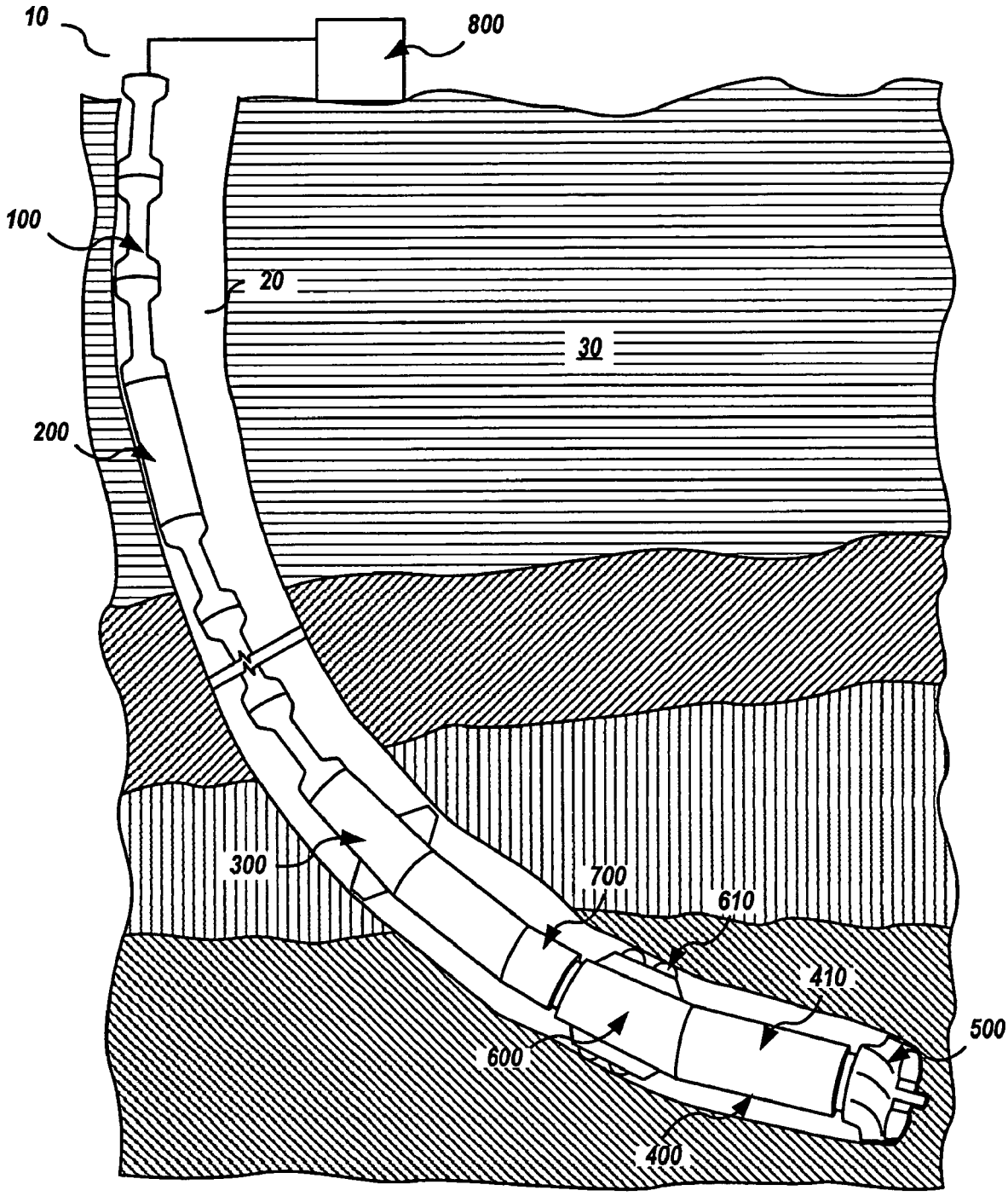
FIG. 1 is a schematic illustration of an example drill string in a borehole.

FIG. 1 schematically illustrates a new drilling method and apparatus. A drill string 10 includes wired drill pipe 100. Drill string 10 is located inside a borehole 20 in a formation 30. Wired drill pipe 100 may include joints of pipe which contain conductors within the drill pipe walls. Wired drill pipe 100 may utilize tubing within the bore of the pipe (e.g., centralized down the center, or biased against the pipe bore inner diameter) to convey conductors. Wired drill pipe 100 may utilize, for example, center stab connectors at each pipe joint, male and female connectors making electrical contact as the drill pipe rotary shouldered connections are made up. In certain embodiments, wired drill pipe 100 may comprise continuous tubing to convey drilling fluid and hang the bottom hole assembly, with conductors either integral with the tubing wall, or contained within a smaller diameter tubing within the bore of the continuous tubing. Wired drill pipe 100 may, for example, convey on the order of 250 kw to 1 MW of electrical power downhole, so as to not depend upon surface rotation or the mud flow for steady power for use in drilling. Wired drill pipe 100 may additionally convey measurement and control signals between surface and various points downhole.

A vibration sub 200 may be utilized at various points in the drill string, to ensure that the string is in a dynamic state even when not rotating or progressing down the hole. A typical logging-while-drilling ("LWD") suite 300 may be utilized for directional and formation sensing. An electric motor sub 400 may be positioned below LWD suite 300 and above a bit 500. Electric motor sub 400 houses an electric motor, not shown in FIG. 1, that drives the rotation of bit 500. Example drill string 10 may alternatively include a fluid-driven motor sub in place of the electric motor sub 400, discussed in greater detail later in this description. Drill string 10 may further include a torque reaction sub 600 and clutch 700, both of which we discuss in greater detail later in this description. A real-time processor 800 may control the operation of drill string 10 and its components, as we also discuss in detail later in this description.

Although not shown in FIG. 1, the electric motor inside electric motor sub 400 could be a brushless DC motor. This brushless DC motor could operate with commutation control as described in U.S. patent application Ser. No. 10/170960, filed Dec. 18, 2003, entitled "Digital Adaptive Sensorless Commutational Drive Controller for a Brushless DC Motor," assigned to the assignee of this disclosure. That is, the brushless DC motor may be commutated by a digital adaptive controller circuit adapted to receive digital back electromotive force detector signals. The back electromotive force detector signals could be used to indicate whether voltages on windings in the brushless DC motor are above a threshold level. The voltages could be compared with previously detected levels to determine whether the winding voltages are as expected. Alternative known methods may instead be used to commutate the brushless DC motor.

In one example drill string 10, a housing 410 for electric motor sub 400 rotates with drill string 10 at, for example, approximately 60 to approximately 250 RPM. Bit 500 rotates relative to housing 410 at a much higher rate, such as approximately 1000 RPM to approximately 2000 RPM. Assuming the same approximate torque is available to bit 500 as would be available with a traditional drilling system (e.g. drilling with just surface-rotation, or with a mud-driven PDM), and the RPM is 10 times higher, the power available to break the rock would be 10 times higher than such a traditional system.

In a conventional drill string, a 6¾-inch mud motor may provide a consistent 100 horsepower (HP) to the bit when drilling an 8½-hole, at 450 gallons per minute (gpm) mud flow rate and 500 psi pressure drop. If an electric motor were substituted for the mud motor to do the same job, this flow rate and pressure drop would correspond to around 74.6 kW of electrical power (not accounting for the efficiency factor of the electric motor, which is generally fairly high). Assuming a full 1 MW of electrical power can be made available to the electrical motor in drill string 10, this increased power represents that full order of magnitude more power than the energy available to a typical mud motor. The operator may prefer, however, to limit the electric power being fed down drill string 10 to electric motor sub 400 to around 250 kW. Even this amount is several times the power available via a typical 6¾-inch mud motor, and the electric power in this case would be available without consuming 500 psi of mud pressure over a mud motor. This pressure is therefore available for other purposes, including increased hole cleaning at bit 500.

In drilling some boreholes, sufficient power may be available downhole, but the power is not in useable form. For example, power available downhole may not be available as speed. An electric motor is especially appropriate for circumstances in which the extra bit speed can be used to more effectively break and remove the rock. Existing diamond bit technology is particularly effective at high speeds, and electric motors would be ideal for driving them.

Whether the higher bit rotation speed is accomplished with the same level of power as is currently used, such as around 100 HP, or at the higher power levels that can be produced as a result of increased electrical power provided to the motor, an optional flywheel may be used to provide even further increased power, or torque at that high speed, for a few moments to minutes when needed to break through a hard spot in a formation. We discuss this flywheel in greater detail later in this description.

The operator may steer bit 500 by maintaining electric motor sub housing 410 in a non-rotating mode, while at the same time biasing the bit. This action may be completed by "pointing" bit 500 with a pair of eccentrics (not shown in the figures), as described in U.S. Pat. No. 6,640,909, entitled "Steerable Rotary Drilling Device," assigned to the assignee of this disclosure. When steering, the operator may then prefer to maintain the motor housing in a sliding mode, with its orientation referenced to the borehole.

In certain circumstances, extreme torque may be desired or required, even just for a moment, to break through a hard region in a formation. To accommodate such an increased torque requirement without excessively winding up drill string 10, a torque reaction sub 600 may be provided to transfer torque into the formation immediately above bit 500 and electric motor sub 400. This transfer would be practical only when the lower portion of the borehole assembly ("BHA"), such as electric motor sub housing 410, is sliding.

Figure 2:
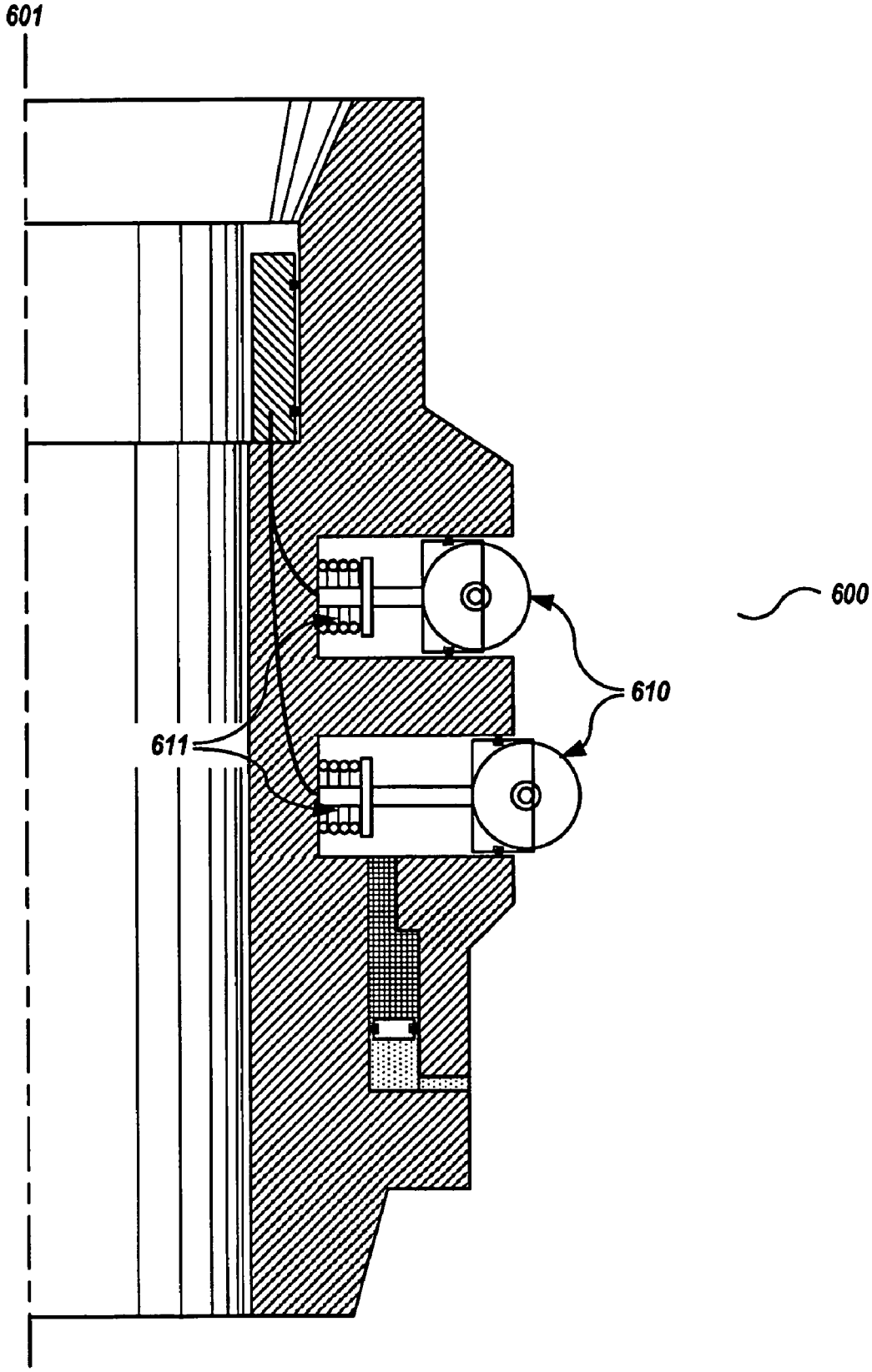
FIG. 2 is a schematic illustration of an example torque reaction sub.

FIG. 2 schematically illustrates an example torque reaction sub 600 in cross-section with center line 601. Example torque reaction sub 600 may include wheels 610, which may be actuated via solenoids 611. For illustrational purposes only, FIG. 2 illustrates one wheel 610 in its retracted position, while another wheel 610 is in its extended position. Wheels 610 may have a hard cutting edge of a material such as carbide or diamond for digging into formation 30. In this case, wheels 610 may align with the axis of borehole 20 and have preferred rolling directions parallel to the borehole axis so as to restrict rotation of the housing of torque reaction sub 600. Alternatively, wheels 610 may include a hard broad area for contact with the wall of borehole 20 and utilize a significant radial force from, for example, solenoids 611. In either case, torque reaction sub 600 may transfer significant torque through wheels 610 while allowing drill string 10 to travel in the axial direction.

In some circumstances, the operator may wish to maintain electric motor sub housing 410 in a sliding mode, when steering or during other operations, such as transferring torque into the formation as referenced above. At the same time, the operator may wish to continue to rotate drill string 10 to remove cuttings and to prevent the drill string from experiencing static drag and sticking in borehole 20. To accommodate both concerns, drill string 10 may optionally include a clutch 700. In particular, drill string 10 may include a dynamic clutch sub, as described in a United States patent application Ser. No. 10/793,062 filed on Mar. 4, 2004, entitled "Providing a Local Response to a Local Condition in an Oil Well", by the same inventors (referred to hereafter as the "Local Response Patent Application").

Figure 3:
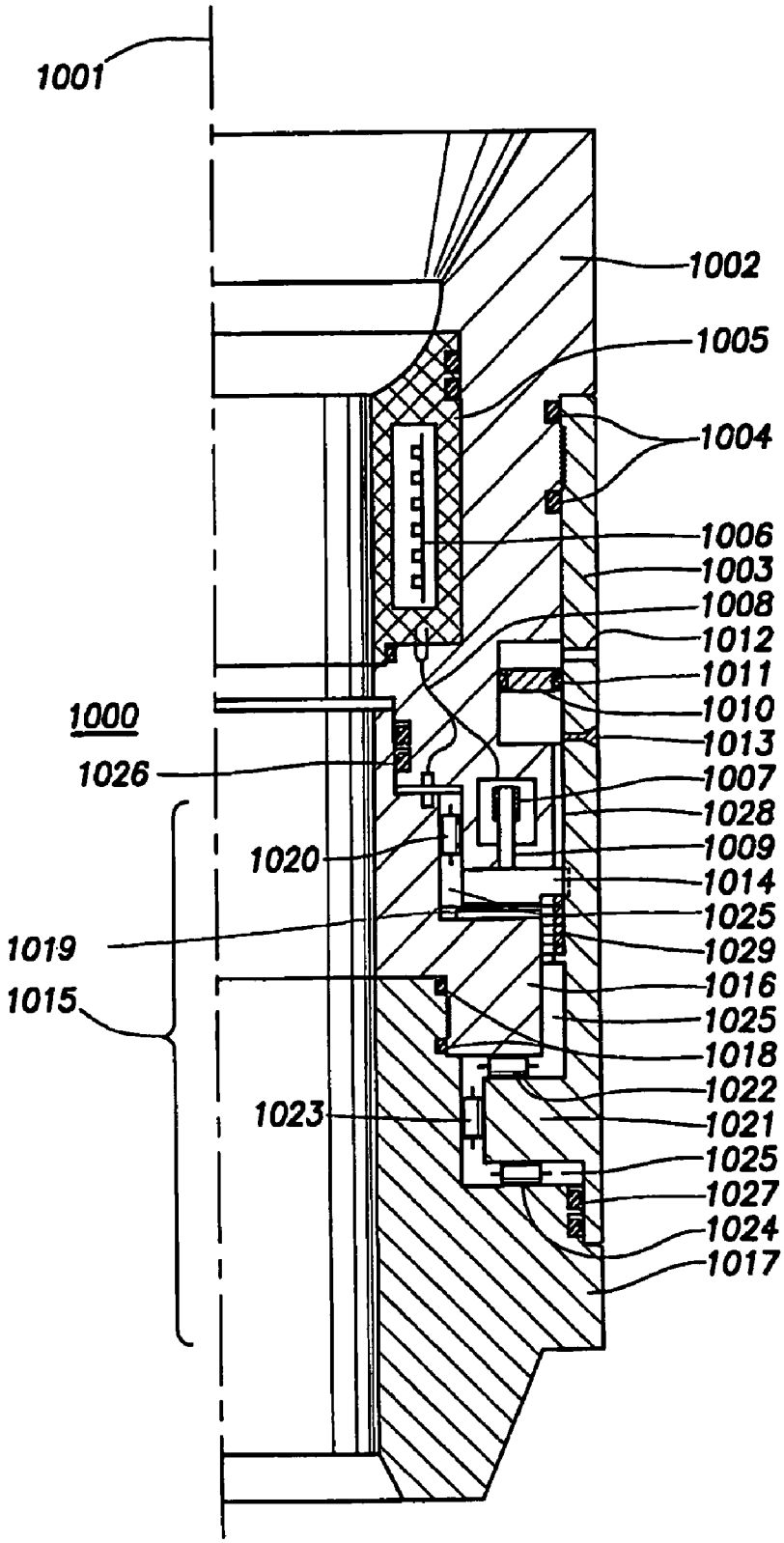
FIG. 3 is a schematic illustration of an example dynamic clutch sub.

FIG. 3 is a cross-sectional, side, schematic drawing of an embodiment of an example dynamic clutch sub 1000 having a center line 1001. The sub has a box connector 1002 at the top for making up to pipe string. A housing 1003 is threaded onto the exterior of the box connector 1002 wherein o-ring seals 1004 complete the connection. An electronics insert 1005 may be connected to the interior of the box connector 1002. A printed circuit board ("PCB") 1006 may be housed within the electronics insert 1005. The printed circuit board may be controllable by surface real-time processor 800, not shown in FIG. 3. Processor 800 may be located outside sub 1000, such as at the surface. PCB 1006 may include one or more sensors, preferably for sensing rotational orientation, rotary speed, tangential accelerations, or torsional strains, as may be useful in control of a dynamic clutch sub. A balance chamber 1010 may be defined between the box connector 1002 and the housing 1003. The balance chamber 1010 may be split into a mud fluid section in the top and a hydraulic fluid section in the bottom by a balance piston 1011. The upper section of the balance chamber 1010 fluidly communicates with the exterior (annulus between the sub and casing, not shown) of the sub 1000 via balance port 1012. Hydraulic fluid may be injected into the balance chamber 1010 through a fill plug 1013. The balance chamber 1010 may also have a spring in the upper mud portion to bias the balance piston 1011.

A rotating mandrel 1015 may be made up to the inside of the box connector 1002 and the housing 1003. The rotating mandrel 1015 may have two parts, a friction section 1016 and a pin connector 1017. The friction section 1016 and the pin connector 1017 may be threaded into each other and o-rings 1018 may complete the connection. A friction plate 1019 may have a ring-like structure and may be attached to an upward facing surface of the friction section 1016. A radial bearing 1020 may be positioned between the friction section 1016 and the box connector 1002. A thrust bearing 1022 may be positioned between the bottom end of the friction section 1016 and a housing flange 1021 that extends radially inward from a lower end of the housing 1003. A radial bearing 1023 may be positioned between pin connector 1017 and the housing flange 1021. A thrust bearing 1024 may be positioned between an upward face of the pin connector 1017 and the housing flange 1021.

A bearing chamber 1025 may be defined between the housing 1003, the box connector 1002, and the rotating mandrel 1015. An upper end of the bearing chamber 1025 may be sealed by rotary seals 1026 between the friction section 1016 and the box connector 1002. A lower end of the bearing chamber 1025 may be sealed by rotary seals 1027 between the pin connector 1017 and the housing 1003. The bearing chamber 1025 may be fluidly connected to the balance chamber 1010 via gap 1028. The balance chamber 1010 enables hydraulic fluid to be maintained in and around the bearing regardless of the pressure being generated on the exterior of the sub 1000.

An array of solenoids 1007 may be connected to the bottom of the box connector 1002. A communication/power bus 1008 communicates control signals between PCB 1006 and the array of solenoids 1007, and in one embodiment also communicates rotary electrical interface 1030 between the opposing faces of the box connector 1002 structure and the rotating mandrel 1015. This rotary electrical interface may comprise simply a relative rotation sensor.

In other embodiments, the communication power bus 1008 also extends through this rotary electrical interface 1030 into the rotating mandrel 1015 for connection to a sensor set (not shown) which may preferably sense similar parameters to those named earlier which may be included with printed circuit board 1006, but here such parameters associated with the rotating mandrel. This extension of communication/power bus 1008 may further extend along the mandrel 1015 and connect to other drill string elements connected to the bottom of the sub. In such embodiments the rotary electrical interface 1030 may comprise an inductive type or brush type interface.

An array of pistons 1009 may extend from the array of solenoids 1007 and have clutch plates 1014 attached thereto. The clutch plates 1014 may be positioned opposite the friction plate 1019 so that when the array of solenoids 1007 is engaged, the clutch plates 1014 extend to contact and press against the friction plate 1019. This action restricts relative rotational movement between the rotating mandrel 1015 and the box connector 1002. A return spring 1029 may be positioned between a flange on the housing 1003 and the clutch plates 1014 to release the clutch plates 1014 from the friction plate 1019 when the array of solenoids 1007 is deactivated. The clutch plates 1014 may also engage in a spline 1028 between the clutch plates 1014 and the housing 1003 to prevent rotational movement while allowing axial movement.

The amount of torque translated from one side of the dynamic clutch sub to the other depends on the control signals applied to the array of solenoids 1007. The control signals may be provided by an independent controller on PCB 1006 or may be provided through the PCB 1006 by real-time processor 800, discussed later in this description. A set or series of clutch and friction plates operating together (not shown) may alternatively be employed, to increase the contact area and thereby reduce the contact pressure requirement in achieving the mechanical torque capacity required. In another embodiment (not shown), the return springs 1029 may be positioned so as to create a default contact condition between clutch plates 1014 and friction plates 1019, thus allowing for slippage and relative rotation only when the solenoids are activated.

Returning to FIG. 1, drill string 10 could be rotated from surface at a relatively low RPM, with clutch 700 engaged in a dynamic manner to continuously and precisely offset reactive torque from the electric motor inside electric motor sub 400 and bit 500 and to carry that reaction up drill string 10 to the surface and into the wall of borehole 20 through frictional losses. This precise offsetting of motor torque allows the operator to maintain electric motor sub housing 410 at an approximately constant orientation within borehole 20—or at least prevent the orientation of electric motor sub housing 410 from varying too quickly for the eccentrics pointing bit 500 to readjust bit 500.

Should bit 500 encounter a particularly hard formation top that requires more torque than drill string 10 can safely accommodate, torque reaction sub 600 can activate rudder wheels 610 to engage the wall of borehole 20 and provide a torque short circuit into formation 30. The BHA can still advance even when rudder wheels 610 engage formation 30. Clutch 700 would disengage fully or maintain a torque transmittal level up drill string 10 that is below the safety threshold of drill string 10 but that still allows the string to be rotated from surface.

A real-time processor 800 may be coupled to drill string 10 and provide real-time control to electric motor sub 400, clutch 700, and torque reaction sub 600. As shown in FIG. 1, processor 800 may be located at surface, if desired. Processor 800, or portions of processor 800, may be located downhole. Processor 800 may comprise two or more processing units that may be distributed within the elements of drill string 10. Processor 800 could control the current available to electric motor sub 400, or torque capacity. Also, processor 800 could control the motor speed for the electric motor in electric motor sub 400 and actuate rudder wheels 610 of torque reaction sub 600 to engage with or disengage from the wall of borehole 20. Processor 800 could also control to partially or fully engage clutch 700. Drill string 10 would require appropriate sensors downhole to help realize these control functions. Any of the control functions of the electric motor sub 400, clutch 700, and torque reactor sub 600 may be performed by distributed controllers that themselves are under the control of processor 800. For example, drill string 10 may include torque and RPM sensors (not shown) at the two sides of clutch 700 and displacement sensors on rudder wheels 610 (also not shown). Further, drill string 10 could feed motor current and back-electromotive forces into the controls.

Figure 4:
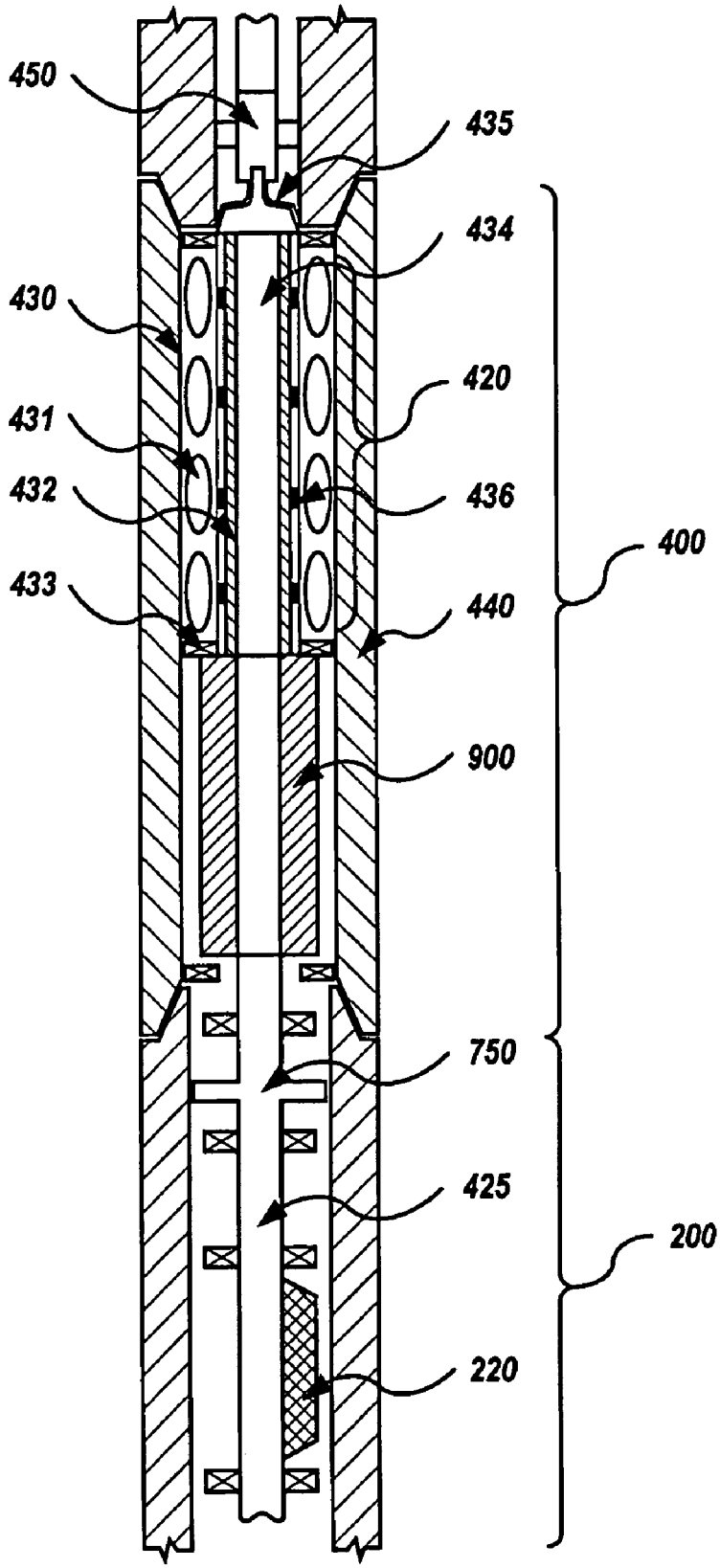
FIG. 4 is a schematic illustration of an electric motor, flywheel, and clutch housed within a drill string, with a shaft available for driving the bit, an alternator, and an optional rotating imbalance for creating a vibration sub.

FIG. 4 schematically illustrates a detailed view of a portion of the above-described drill string, with electric motor sub 400. An electric motor 420 inside electric motor sub 400 couples to a shaft 425. Shaft 425, in turn, may couple to bit 500, not shown in FIG. 3. Shaft 425 may alternatively or additionally couple to a vibration sub, discussed later in this description. An example electric motor 420 may include windings to form a stator 430 that is fixed within a collar 440. Given the form-factor requirements of the drilling environment, stator 430 may comprise multiple stators 431 in series driving a single rotor 432. Rotor 432 may include sets of magnets 436 arranged around the rotor, with a magnet set 436 corresponding to each of the multiple stators 431. The multiple stators 431 may be configured with the multiple rotor magnet sets 436 to provide for establishing a closed magnetic circuit at each stator "stage." Such an arrangement may enable electric motor 420 to provide a greater power output than a single-stage electric motor could provide. Rotor 432 may be on radial and thrust bearings 433 (shown schematically) and may have a channel 434 for mud flow. An inner sleeve (not shown) may optionally be used on bearings within rotor 432 and fixed from rotation from a key above or below, to prevent mud flow from interacting with rotor 432 as it rotates at high speeds. The motor windings may be wired to via hanger interface 435 to a sonde 450 centralized within collar 440 above electric motor 420. Sonde 450 may optionally contain elements of motor control circuitry, and communications interface to real-time processor 800, not shown in FIG. 4. Processor 800 may be located outside sonde 450; for example, processor 800 may be located on the surface. Hanger interface 435 may provide an electrical interface while permitting the mud flow to transition from annular flow around sonde 450 to center flow through rotor 432.

Rotor 432 may be fixed to an optional flywheel 900 below or above rotor 432. Flywheel 900 may provide rotor 432 with an inertia that allows the electric-motor-flywheel combination to provide a power output on an impulse or a short-term basis that is greater than the output by electric motor 432 alone. Such increased power may be useful for a number of purposes, including breaking a particularly hard rock section embedded in an otherwise drillable formation. For example, electric motor 420 can drive bit 500 and flywheel 900 at speeds of approximately 1000 RPM to approximately 3000 RPM. The electric motor, bit and flywheel combination can thereby develop much greater power (as calculated by multiplying speed by torque) for breaking and clearing formations than the power generated through traditional rotary- or mud-motor-based drilling.

An example flywheel 900 for use in a 6¾-inch collar might be 5 feet long and have a 4.6-inch outside diameter and 3-inch inside diameter. If, for example, flywheel 900 is made of steel, and spinning at 3000 RPM, it could provide kinetic energy on an "as needed" basis of 10,300 ft-lbs, or 18.7 HP-seconds. As bit 500 engages a hard spot in the formation, and the torque requirement subsequently increases impulsively corresponding to approximately one bit revolution at 3000 RPM (i.e., 0.02 seconds), the energy supplied by flywheel 900 would represent an extra 935 HP for that brief interval.

Various design parameters of flywheel 900 can be adjusted to provide greater stored energy. A 25-foot flywheel may be implemented within a standard length, or 30-foot, collar; if made of steel, such a flywheel would provide 95 HP-seconds of energy. If flywheel 900 is made of a heavier substance such as tungsten, it could provide more than double the energy that a comparably-designed steel flywheel 900 could provide. We have thus far discussed flywheels of relatively small diameters. To drill larger holes, drill string 10 may employ a flywheel 900 with a significantly larger outside diameter. A 9⅝ inch outside diameter sub could be used in drilling 12¼-inch or larger holes and could employ a flywheel with a 7-inch outer diameter and a 5-inch inner diameter. That change would increase the energy capability of flywheel 900 by a factor of four times, other design parameters being equal.

Flywheel 900 could alternatively be clutched in and out of the rotation path. FIG. 4 illustrates a clutch assembly 750 that could be used for engaging the flywheel to the shaft or engaging the motor to the flywheel (not shown), as described earlier in this description.

Flywheel 900 also can be used for other purposes. During connections, such as when operators add new drill pipe at the surface, the electrical power supplied through wired drill pipe 100 may be disconnected. By using flywheel 900 to drive an alternator (not shown in FIG. 4), or simply allowing flywheel 900 to back-drive electrical motor 420, ample electrical power can be made available for most functions. The drilling would probably not be taking place during the addition of pipe, as the mud flow and the weight on bit 500 from the surface will also be interrupted. However, circumstances may require that drill string 10 keep moving, and flywheel 900 may be used to maintain the dynamic state of drill string 10.

For example, flywheel 900 could directly engage a mechanical vibration sub 200 through clutch 750, as shown in FIG. 3. Vibration sub 200 may be a limber sub with external outside-diameter reliefs to reduce stiffness. This sub could contain another smaller offset flywheel 220 on bearings about shaft 425 but with its center of mass offset from the center of collar 440. As flywheel 900 engages through clutch 750, offset flywheel 220 represents a rotating imbalance and would shake collar 440 and a significant part of drill string 10. Through gearing, the shake frequency of vibration sub 200 could be designed to be low, or even intermittent yet periodic, so as to conserve the energy of flywheel 900 and provide a longer period of utility until electrical power is reestablished. Drill string 10 can also employ vibration subs 200 or other rotating imbalances up and down drill string 10 during drilling to help maintain consistent weight transfer from surface and reduce the likelihood of drill string 10 sticking to the side of borehole 20. Multiple vibration subs 200 could be employed at several locations along drill string 10 to keep it dynamic.

Figure 5:
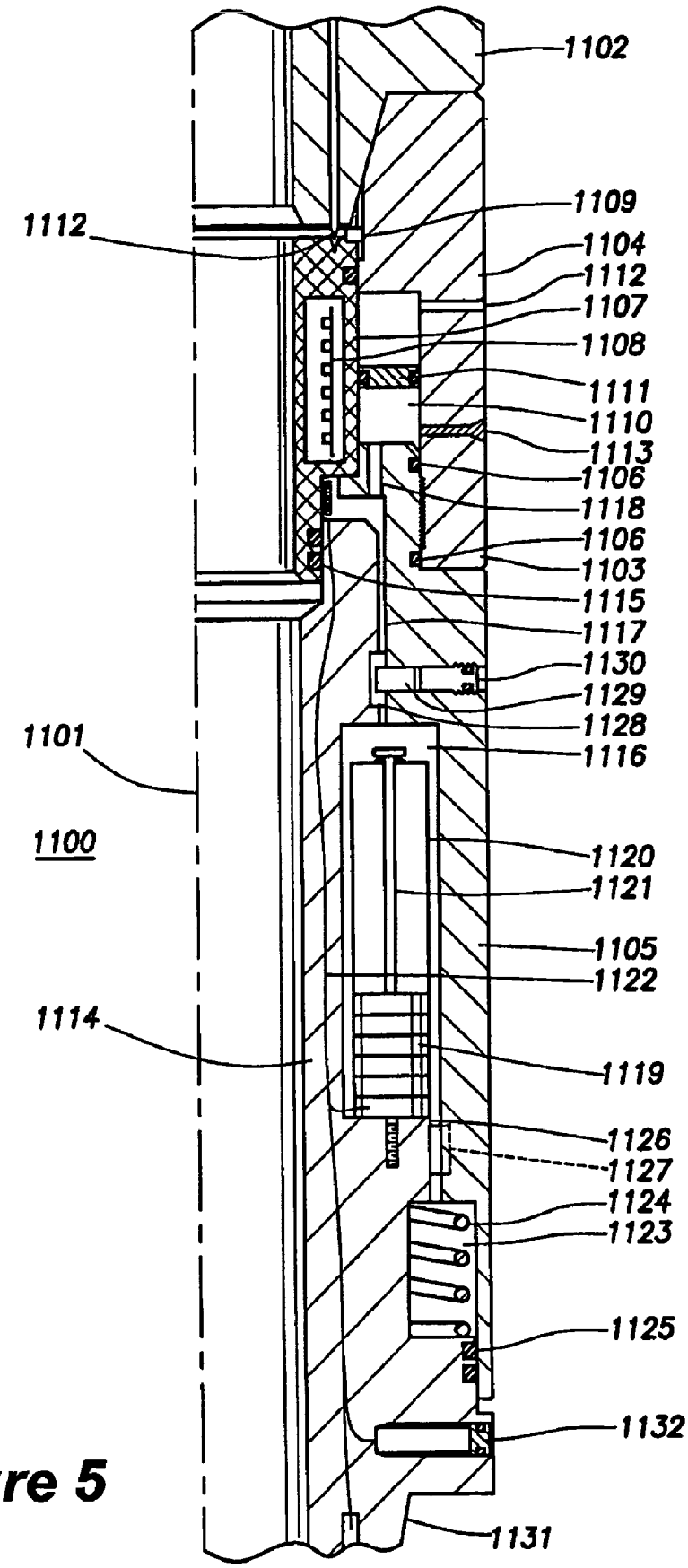
FIG. 5 is a schematic illustration of an example vibration sub.

As discussed earlier in this description, flywheel 900 can be used to generate electricity. The electric power can be used to drive vibration sub 200. An example of an electrically powered vibration sub 200 might be a piezo-vibration sub, as described below. FIG. 5 illustrates schematically an example vibration sub 1100 in cross-section with center line 1101. A portion of a pin sub 1102 is also shown to which the vibration sub 1100 is made up. The vibration sub 1100 has a housing 1103 made of two sections which are threaded together. The upper housing 1104 has a female thread into which male threads on the lower housing 1105 are threaded. O-ring seals 1106 complete the connection. An electronics insert 1107 may be positioned between the upper housing 1104 and the lower housing 1105, and may be clamped in and keyed to the upper housing 1104 via locking ring 1109. A printed circuit board 1108 may be contained within the electronics insert 1107. A connector 1112 extends from the pin sub 1102 for electrical communication with the electronics insert 1107. The printed circuit board may be controllable by the surface real-time processor 800. The printed circuit board may include one or more of the sensors discussed earlier in this description for use with dynamic clutch sub 1000; the PCB may preferably include an axial vibration sensor or accelerometer useful for control of the vibration sub. A balance chamber 1110 may be defined between upper housing 1104, lower housing 1105, and electronics insert 1107. The balance chamber 1110 may be divided into a mud portion above and a hydraulic portion below by a balance piston 1111. The mud portion of the balance chamber 1110 above the balance piston 1111 communicates with the borehole annulus mud via balance port 1112. The oil side of the balance chamber 1110 below the balance piston 1111 communicates with the inner diameter of the vibration sub 1100 via balance port 1108. Hydraulic fluid is inserted into the balance chamber 1110 through fill plug 1113.

A mandrel 1114 may be made up within a lower housing 1105. The upper portion of the mandrel 1114 is inserted between lower housing 1105 and electronics insert 1107, wherein o-ring seals 1115 seal the connection between the mandrel 1114 and the electronics insert 1107. A stack chamber 1116 may be defined between the lower housing 1105 and the mandrel 1114. The stack chamber 1116 may be in fluid communication with the balance chamber 1110 via a gap 1117 between the mandrel 1114 and the lower housing 1105. The two chambers may be in further fluid communication to the balance chamber 1110 (oil side) through port 1118 in an upper portion of the lower housing 1105.

Within the stack chamber 1116, an annular stack of piezo electric crystals 1119 may be secured to the mandrel 1114. An annular tail mass 1120 may be positioned immediately on top of the piezo electric crystals 1119. Tension bolts 1121 may extend through the tail mass 1120 and the piezo electric crystals 1119 and thread directly into the bottom of the stack chamber 1116 defined by the mandrel 1114. The tension bolts 1121 keep the piezo electric crystals 1119 and tail mass 1120 in compression. An electrical communication/power bus 1122 extends from the electronics insert 1107 to the piezo electric crystals 1119. As before, the characteristics of the dynamic vibration sub may be controlled via the circuit board 1108 by surface real-time processor 800.

A spring chamber 1123 may also defined between the lower housing 1105 and the mandrel 1114. A spring 1124 may be positioned within the spring chamber 1123 to engage the mandrel 1114 at the bottom and the lower housing 1105 at the top. The spring chamber 1123 may be sealed by o-ring seals 1125 at the bottom. The spring chamber 1123 may be in fluid communication with the stack chamber 1116 through a gap 1126 between the mandrel 1114 and the lower housing 1105. A spline 1127 may be configured in the gap 1126 to prevent relative rotational movement between the mandrel 1114 and the lower housing 1105 while allowing relative movement in the axial direction.

An upper portion of the mandrel 1114 may have a notch 1128 for receiving multiple keys 1129 which extend from the lower housing 1105. The keys may be secured in the lower housing 1105 by sealed plugs 1130. The keys 1129 prevent rotation and retain the mandrel 1114 within the housing 1103 when the vibration sub 1100 is in tension. The vibration sub 1110 is placed in tension, for example, when pipe string is made up to the pin connector 1131 and suspended below the vibration sub 1100 and especially when the pipe string is being tripped in or out of the borehole.

The vibration sub 1100 may also include a mini-sensor set 1132. The sensors of the sensor set 1132 are positioned in the exterior of the mandrel 1114 where the mandrel extends below the housing 1103. The sensor set 1132 may be electrically connected to the communication/power bus 1122 by copper with a seal plug, and preferably includes the sensors as noted above that might be useful in monitoring and/or controlling the vibration sub.

Figure 6:
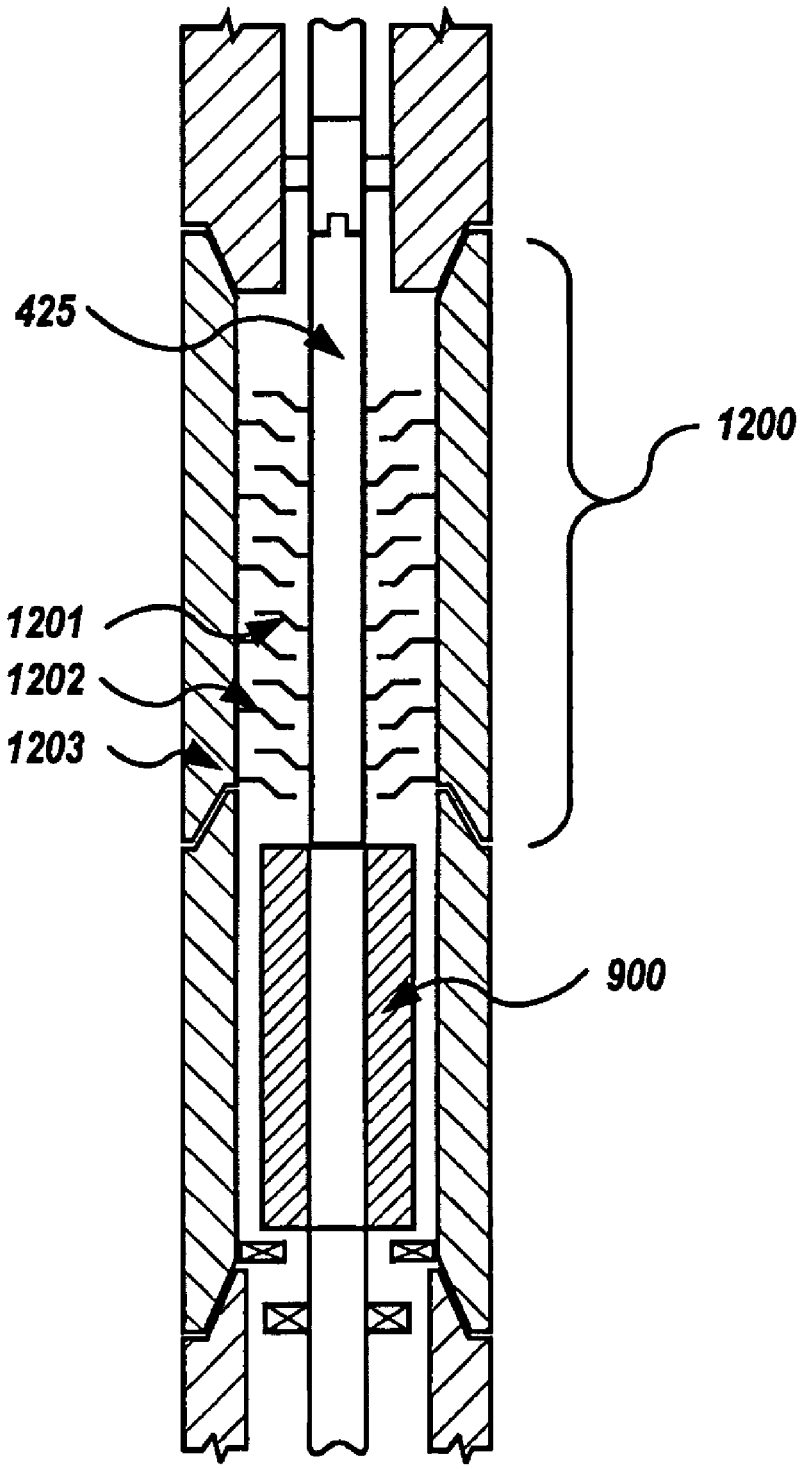
FIG. 6 is a schematic illustration of a drill string turbine and flywheel.

In certain implementations of the drilling apparatus, a fluid-driven motor may be substituted for the electric motor sub 400. A fluid-driven motor may be of a positive displacement type or may be a drill string turbine. FIG. 6 illustrates schematically a cross-section of a portion of drill string 10 with a turbine 1200. Drill string turbine 1200 may include multiple stages of rotors 1201 and stators 1202, the rotors 1201 coupled to drive the shaft 425, and the stators 1202 coupled to the housing 1203 of drill string turbine 1200. Drill string turbine 1200 may be implemented without conveying significant electrical power from surface, as the power for drilling is derived from the mud flow: each of the multiple rotors 1201 extracts some of the power from the mud flow, and together they drive shaft 425. Although not shown in FIG. 6, drill string turbine 1200 may include 50 to 100 or more rotor/stator stages, and shaft 425 may be driven at, for example, around 1000 RPM. Such drill string turbines are used today in certain drilling situations, often with diamond bits. Drill string turbine 1200 may be coupled with a flywheel 900 as per earlier descriptions, and the turbine-plus-flywheel combination may be used in overcoming hard-to-drill circumstances as described earlier for electric motor sub 400. Moreover, flywheel 900 could drive an alternator (not shown in FIG. 6) to provide electrical power to LWD suite 300, vibration sub 200, or for other electrical needs drilling-stoppage periods when mud flow has also stopped.

The term "couple" or "couples" used herein is intended to mean either an indirect or direct connection. Thus, if a first device couples to a second device, that connection may be through a direct connection, or through an indirect electrical connection via other devices and connections.

The present invention is therefore well-adapted to carry out the objects and attain the ends mentioned, as well as those that are inherent therein. While the invention has been depicted, described and is defined by references to examples of the invention, such a reference does not imply a limitation on the invention, and no such limitation is to be inferred. The invention is capable of considerable modification, alteration and equivalents in form and function, as will occur to those ordinarily skilled in the art having the benefit of this disclosure. The depicted and described examples are not exhaustive of the invention. Consequently, the invention is intended to be limited only by the spirit and scope of the appended claims, giving full cognizance to equivalents in all respects.

What is claimed is:

1. A system for drilling a borehole with a drill bit and with wired drill pipe conveying electrical power from surface, the system comprising:

an electric motor electrically and mechanically couplable to the wired drill pipe;

a shaft coupled to the electric motor and couplable to the drill bit, where the shaft rotates when power is supplied to the electric motor;

a flywheel able to be rotatingly engaged with one of the drill bit and the shaft; and a clutch to selectively engage the flywheel to the drill bit and the shaft.

2. The system of claim 1, where the electric motor rotates the shaft at a rotation rate greater than that of a rotary table.

3. The system of claim 1, where the electrical motor rotates the shaft at a rotation rate greater than approximately 1000 RPM.

4. The system of claim 1, where the electric motor is a brushless direct-current electric motor.

5. The system of claim 1, where the electric motor comprises a plurality of stator stages.

6. A drill string for use in drilling a borehole, the drill string comprising:

an electric motor;

a clutch; and a flywheel rotatably engagable with said motor.

7. The drill string of claim 6, further comprising a sensor to measure a parameter related to drilling the borehole.

8. The drill string of claim 6, further comprising a torque-reaction device.

9. The drill string of claim 6, further comprising a drill string component to create a dynamic state in the local drill string.

10. The drill string of claim 9, where the component includes a rotating imbalance.

11. The drill string of claim 9, where the component includes a vibration sub.

12. A method for drilling a borehole with a drill string, the method comprising:

transferring power from surface to an electric motor in the drill string via wired drill pipe, where the electric motor is electrically and mechanically coupled to the wired drill pipe;

rotating a shaft coupled to the electric motor when power is supplied to the electric motor;

increasing the power available to the drill bit by engaging a flywheel, where the flywheel is rotatably engagable with one of the electric motor and the shaft;

engaging selectively a clutch to couple the flywheel to the drill bit and the shaft; and wearing away earth with a drill bit coupled to the shaft to form the borehole.

13. The method of claim 12, where rotating the shaft comprises rotating the shaft at a rotation rate greater than that of a rotary table.

14. The method of claim 12, further comprising generating electricity below the surface with a flywheel.

15. The method of claim 14, further comprising driving one or more vibration subs with the electricity generated with the flywheel.

16. The method of claim 12, further comprising:

storing energy with a flywheel that is rotatably engagable with one of the electric motor and the shaft, and drawing upon the stored energy during one or more interruptions in the transfer of power from the surface.

17. The method of claim 12, further comprising creating a dynamic state in the local drill string.

18. The method of claim 12, further comprising disengaging the drill bit from the shaft with a clutch coupled to the drill bit and to the shaft.

19. The method of claim 12, further comprising measuring a parameter related to drilling the borehole with a sensor on the drill string.

20. The method of claim 12, further comprising controlling the operation of the electric motor from the surface.

21. The method of claim 12, further comprising transferring torque into a formation with a torque reaction sub.

22. A method for drilling a borehole with a drill string, drilling fluid circulating through the drill string, and a bit, the method comprising:

extracting hydraulic power from the circulating drilling fluid to rotate a shaft with a fluid-driven motor, where the fluid-driven motor is coupled to the drill string and coupled to the drill bit;

engaging the shaft with a flywheel to rotate the flywheel;

coupling the shaft to the drill bit;

engaging selectively a clutch to couple the flywheel to the drill bit and the shaft; and wearing away earth with the drill bit to form the borehole.

23. The method of claim 22, where the fluid-driven motor is a turbine.

24. The method of claim 22, further comprising drawing power from the flywheel to rotate the drill bit.

25. A drill string for use in drilling a borehole, the drill string comprising:

an electric motor;

a flywheel rotatably engagable with said motor; and a vibration sub to create a dynamic state in the local drill string.

26. A method for drilling a borehole with a drill string, the method comprising:

transferring power from surface to an electric motor in the drill string via wired drill pipe, where the electric motor is electrically and mechanically coupled to the wired drill pipe;

rotating a shaft coupled to the electric motor when power is supplied to the electric motor;

using a vibration sub to create a dynamic state in the local drill string; and wearing away earth with a drill bit coupled to the shaft to form the borehole.

* * * * *